US006709187B2

(12) United States Patent
Loh

(10) Patent No.: US 6,709,187 B2
(45) Date of Patent: Mar. 23, 2004

(54) LINEAR CONNECTOR OF PLASTIC MATERIAL FOR JOINING HOLLOW SPACING PROFILES AND HOLLOW BAR PROFILES OF MULTIPLE INSULATING GLASSES

(75) Inventor: Walter Loh, Kaufbeuren-Neugablonz (DE)

(73) Assignee: CERA Handelsgesellschaft mbH (DE)

( * ) Notice: Subject to any disclaimer, the term of this patent is extended or adjusted under 35 U.S.C. 154(b) by 0 days.

(21) Appl. No.: 10/055,592

(22) Filed: Jan. 23, 2002

(65) Prior Publication Data

US 2002/0102127 A1 Aug. 1, 2002

(30) Foreign Application Priority Data

Jan. 29, 2001 (DE) ..... 201 01 486 U

(51) Int. Cl.[7] ..... E06B 3/66
(52) U.S. Cl. ..... 403/298; 403/292
(58) Field of Search ..... 403/300, 301, 403/302, 303, 292, 293, 294, 297, 298

(56) References Cited

U.S. PATENT DOCUMENTS 5,642,957 A * 7/1997 Lange ..... 403/297
6,347,902 B1 * 2/2002 Loh ..... 403/298
6,406,213 B1 * 6/2002 Dohman et al. ..... 403/298

* cited by examiner

*Primary Examiner*—John R. Cottingham
(74) *Attorney, Agent, or Firm*—Gifford, Krass, Groh, Sprinkle, Anderson & Citkowski, P.C.

(57) ABSTRACT

A linear connector for joining hollow spacing profiles and hollow bar profiles of a multiple insulating glass. The connector includes a flat, longitudinal body which is to be inserted at one end into a first spacing profile and with its other end into a second spacing profile. The surfaces of the connector are provided with an abutment element positioned at its center. The abutment element touches the front faces of the spacing profiles on insertion of the linear connector into the spacing profiles which are to be connected to one another. The longitudinal body includes a double-T-cross-section having distantly parallel and horizontal cross-bars which are connected by at least one vertical center bar and contacted at least partly in the mounted condition of the linear connector by the opposing surfaces of the inner wall of the spacing profiles. At least one of the two cross-bars of the double-T-cross-section is provided in the center of its length with a recess so that welding of spacing profiles by heat treatment is possible without melting the plastic material of the linear connector.

7 Claims, 2 Drawing Sheets

LINEAR CONNECTOR OF PLASTIC MATERIAL FOR JOINING HOLLOW SPACING PROFILES AND HOLLOW BAR PROFILES OF MULTIPLE INSULATING GLASSES

RELATED APPLICATION

This application claims priority of German Application No. 201 01 486.6 filed Jan. 29, 2001.

BACKGROUND OF THE INVENTION

The invention relates to a linear connector of plastic material for joining hollow spacing profiles and hollow bar profiles of multiple insulating glasses. Linear connectors of such a kind are known from EP 0 681 083 having a cross section configuration dimensioned to be received into the cross-section of the hollow spacing profiles which are to be connected to one another. These types of linear connectors are generally configured such that the hollow profiles are held together within the abutment area of the linear connector after mounting. There are certain cases, however, in which the demands upon the connection of the hollow profiles are not sufficiently fulfilled because the connection force provided by these types of connectors is only based on frictional forces between the surfaces of the linear connector and the surfaces of the inner walls of the spacing profiles.

SUMMARY OF THE INVENTION

It is therefore an object of the invention to develop a linear connector comprising a flat, longitudinal body of which its one end is insertable into one spacing profile and its other end is insertable into a second spacing profile which are to be connected to one another. A surface of the body of the connector is provided with at least one abutment element in the center of the linear connector which upon insertion of the linear connector into the spacing profiles to be connected to one another is operative to abut the profile front faces respectively. The longitudinal body is provided with a double-T-cross-section with distantly parallel and horizontal cross-bars which are joined by at least one vertical center bar and at least partly touch in the mounted condition of the linear connector to the opposing surfaces of the inner wall of the profiles. The inventive linear connector is provided to improve the sealing effect between the body of the linear connector at the joining gap and the bodies of the spacing profiles which are to be joined.

It is a further object of the invention to improve the joining forces of the hollow bar profiles of the mounting and the linear connector.

A still further object of the invention is to further improve the durability of the joint of linear connectors and spacing profiles and bar profiles as part of multiple insulating glass units.

If the spacing profiles are of metal, it has been proposed to join the hollow spacing profiles at their abutting faces by welding. In such cases, however, the linear connector of plastic material should not be destroyed by the influence of the heat during the welding process.

Thus, it is a still further object of the invention to configure the linear connector such that damage to the linear connector is avoided without obstructing, however, the welding process and the formation of the requested welding seam.

These and other objects of the invention are solved by a construction characterized in that at least one of the two cross-bars is provided in the center of its length with a recess. The recess makes visible the surface of the joined spacing profiles within the area of their ends having the front faces of the spacing profiles connected to one another, and wherein the recess enables welding of these ends under heat without melting the plastic material of the linear connector.

It is especially important to configure the recess such that the strength of the linear connector, which is directly dependent on the cross-section of the connector, will not be affected negatively such that the connector cannot fulfill its function. Therefore, preferably one cross-bar is recessed in the joining area so that the metallic surfaces of the spacing profiles, which in general consist of aluminum, become visible so that a welding seam or welding point may be established closing also the gap between the front faces of the spacing profile bodies to be joined. This provides that the drying substance within the hollow space of the spacing profiles be contained within the joining area of the spacing profiles.

DESCRIPTION OF THE DRAWINGS

A better understanding of the invention will be obtained with reference to the following detailed description when read in conjunction with the accompanying drawings in which.

DESCRIPTION OF PREFERRED EMBODIMENTS

Figure 1:
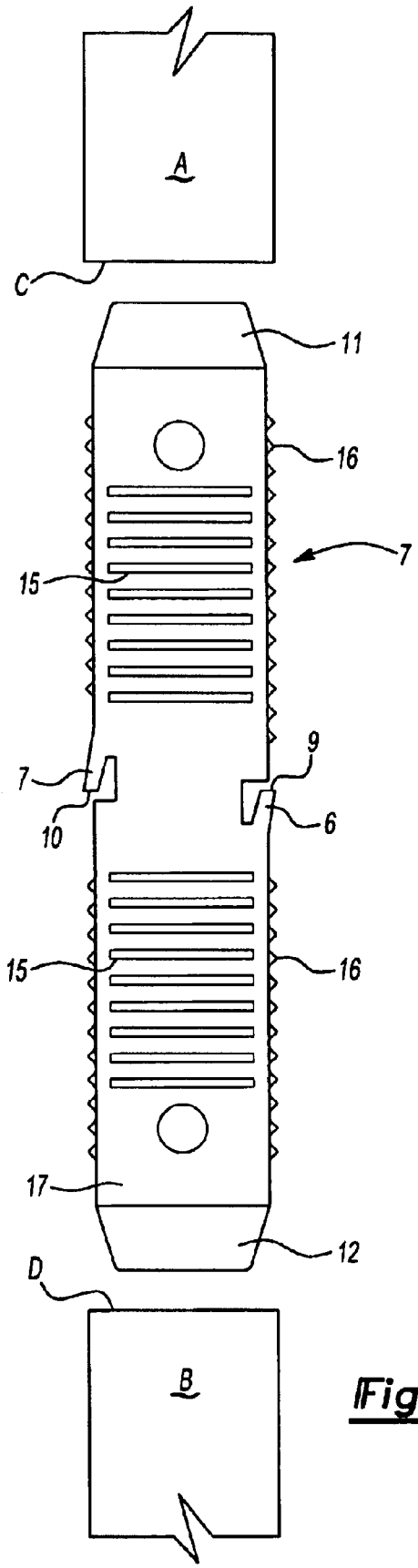
FIG. 1 is a plan view of the linear connector.

The linear connector 1 as shown in FIGS. 1–4 is provided with a flat, longitudinal body. One end 11 of the body is insertable into one spacing profile A schematically shown in the drawings and the other end 12 is insertable into the other spacing profile B which is also schematically shown. This is done to connect the two spacing profiles, also called hollow profiles, to one another before the spacing profiles are laterally disposed with the panes of the multiple insulating glass.

The linear connector comprises a well known double-T-cross-section provided with an upper horizontal cross-bar 2 and a lower horizontal cross-bar 3 which are differing in this example with respect to their width in order to adapt them to the cross-section of the spacing profiles. The upper 2 and lower 3 cross-bars are joined by a vertical or almost vertical center bar 5 provided with apertures 13 and 14 in order to save material but also to improve the throughput of the drying substance as is well known in the art.

A centric abutment element 8 is provided on the surface 17 of the lower cross-bar 3 in the middle of the length of the linear connector. The abutment element 8 has the configuration of two laterally extending abutment tongues 6, 7. The one abutment tongue 6 is directed with its face or abutment surface 9 to the end 11 of the linear connector whereas the other abutment tongue 7 is directed with its face or abutment surface 10 to the other end 12 of the linear connector. Upon shifting or inserting the spacing profiles A and B onto the linear connector, the front faces C or D contact the faces 9 and 10, respectively, in order to prevent the linear connector from being inserted too far into the spacing profile. Instead of the above mentioned abutment elements other configurated or arranged abutment elements may also be used in this connection. As soon as mounting has been accomplished, the front faces C and D of the spacing profiles are in touch with one another at least partly.

Figure 2:
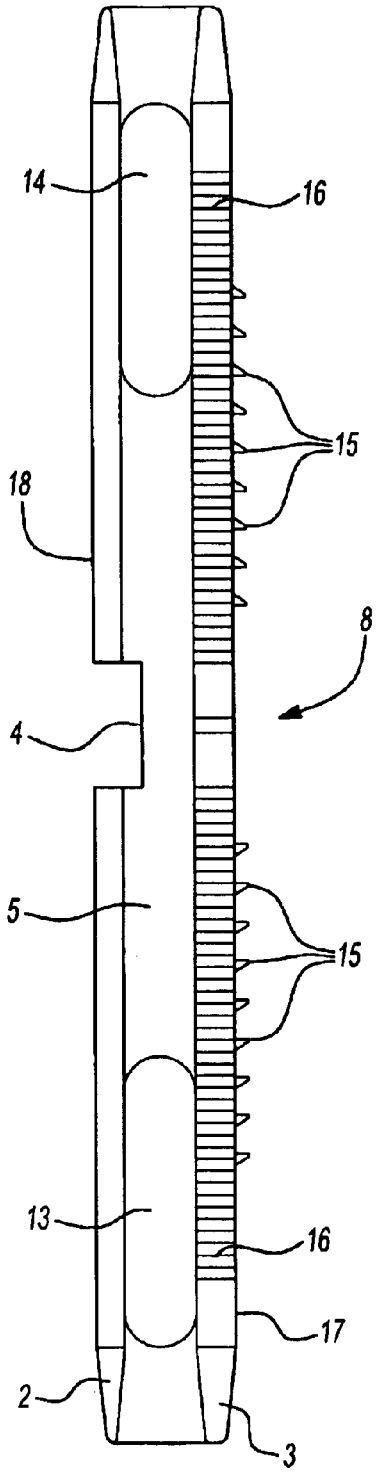
FIG. 2 is a lateral view of the linear connector of FIG. 1.
Figure 3:
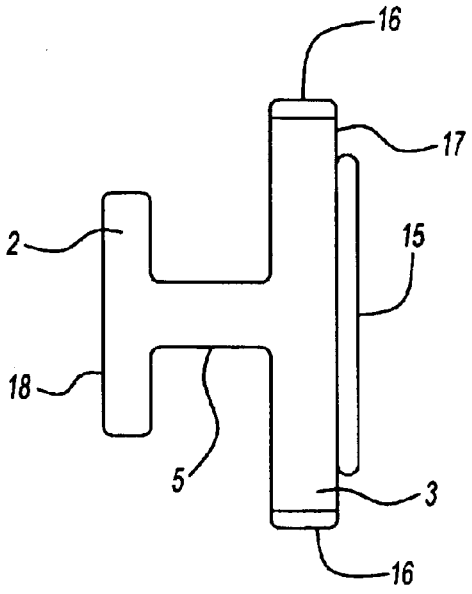
FIG. 3 is a front view of the linear connector of FIG. 1.
Figure 4:
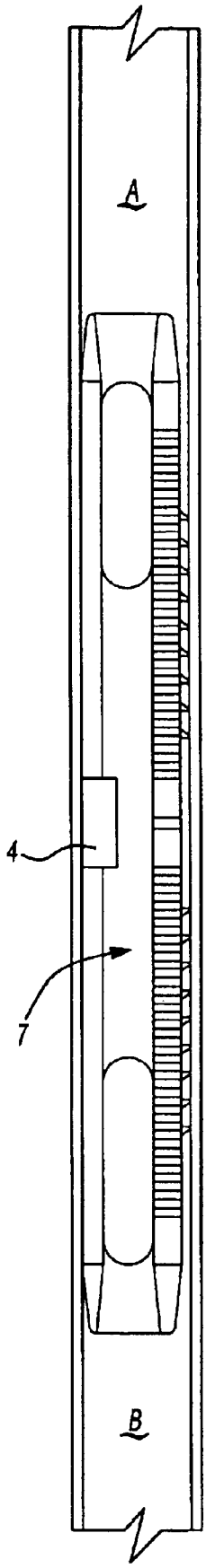
FIG. 4 is a longitudinal sectional view of the linear connector mounted inserted into the hollow spacing profiles.

In order to fix the linear connector within the hollow spaces of the spacing profiles A and B, cross-ribs 15 and 16 are provided on the surfaces of the linear connector as shown by the FIGS. 1 and 2 across the direction of insertion and thus across the width of the linear connector. This is true with respect to the cross-ribs 15 on the horizontal surface of the linear connector as well as the much shorter bars 16 on both of the smaller side faces of the lower cross-bar 3. The frictional forces caused by these ribs on the surfaces of the hollow spacing profiles operate to fix the linear connector within the hollow spaces without opening a gap between their front faces C and D.

In order to further improve the connection of the spacing profiles, and especially to secure the connection under extreme conditions, the metallic hollow spacing profiles A and B may be welded in the joining area without melting the mounted linear connector consisting of plastic material. In such case, the upper cross-bar 2 is provided in its surface 18, about in the center of the linear connector, with a recess 4 extending into the vertical center rib 5. This recess 4, however, is configured such that it does not weaken the cross-section of the linear connector in the stated area in a way which substantially affects its strength. The recess 4 is visible in the mounting condition of the linear connector and the spacing profiles A and B abutting at their front faces C and D so that welding of these profiles may be arranged in the abutting area, i.e. on one of the four surfaces of its rectangular profile. Thus, because of size and configuration of the recess 4, the recess 4 operates to prevent the plastic material of the linear connector from melting on welding the metallic spacing profiles.

Instead of only one recess 4, several similar or different recesses may be used if necessary. Accordingly, it is possible to arrange the recess or recesses not only on one surface of the spacing profiles which are to be connected but also on further surfaces.

What is claimed is:

1. Linear connector of plastic material for joining hollow spacing profiles (A, B) and hollow bar profiles of a multiple insulating glass, comprising a flat, longitudinal body which is to be inserted with its one end into the spacing profile (A) and with its other end into the spacing profile (B) which are to be connected to one another, the surface of said body is provided with an abutment element positioned in the center of the linear connector, which abutment element touches the front faces (C) and (D) of the spacing profiles on insertion of the linear connector into the spacing profiles, wherein the longitudinal body comprises a double-T-cross-section, the distantly parallel and horizontal cross-bars of which being connected by at least one vertical center bar and contacted at least partly in mounted condition of the linear connector by the opposing surfaces of the inner walls of the spacing profiles, characterized in that at least one of the two cross-bars is provided in the center of its length with a recess making visible the surfaces of the metallic spacing profiles in the mounted condition of the connector within the area of their ends comprising the front faces of the spacing profiles positioned opposite to one another so that welding of these ends by heat treatment is possible without melting plastic material of the linear connector.

2. Linear connector according to claim 1, characterized in that the recess extends into the vertical center bar.

3. Linear connector according to claim 1, characterized in that the recess extends over the entire width of the cross-bar.

4. Linear connector according to claim 1, characterized in that the recess is rectangularly configurated.

5. Linear connector according to claim 1, characterized in that the width of the recess measured in direction of the width of the bar is smaller than its length measured between the ends of the linear connector.

6. Linear connector according to claim 1, characterized in that the recess is provided in the one cross-bar and the centric abutment element is provided in the other cross-bar.

7. Linear connector according to claim 6, characterized in that the centric abutment element comprises two abutment tongues extending from the cross-bar, one of these tongues is directed with its front side face to the one end of the linear connector and the other tongue is directed with its front side face to the other end of the linear connector.

* * * * *